US005498821A

United States Patent [19]

Ryan et al.

[11] Patent Number: 5,498,821

[45] Date of Patent: Mar. 12, 1996

[54] CARBON DIOXIDE ADDITION IN HYDROCRACKING/HYDROISOMERIZATION PROCESSES TO CONTROL METHANE PRODUCTION

[75] Inventors: Daniel F. Ryan; Robert J. Wittenbrink, both of Baton Rouge, La.

[73] Assignee: Exxon Research and Engineering Company, Florham Park, N.J.

[21] Appl. No.: 293,362

[22] Filed: Oct. 13, 1994

[51] Int. Cl.[6] ..... C07C 5/13

[52] U.S. Cl. ..... 585/750; 585/751; 585/739; 208/136; 208/137; 208/141

[58] Field of Search ..... 208/135, 136, 208/137, 141; 585/739, 745, 750, 751

[56] References Cited

U.S. PATENT DOCUMENTS

| | | | |
|---|---|---|---|
| 2,250,410 | 4/1939 | Peski | 585/741 |
| 3,711,399 | 1/1973 | Estes et al. | 208/112 |

*Primary Examiner*—Asok Pal
*Assistant Examiner*—Bekir L. Yildirim
*Attorney, Agent, or Firm*—Jay Simon

[57] ABSTRACT

Methane is suppressed in a hydroisomerization process without substantial effect on light gas and light liquid yields when carbon dioxide is included with the feed and a Group VIII non-noble metal or Group VI metal catalyst supported on alumina or silica-alumina.

11 Claims, 12 Drawing Sheets

700 °F+ Wax Conversion
80.00
70.00
60.00
50.00
40.00
30.00
20.00
10.00
0.00
0
100
200
300
400
500
600
700
800
900
Hours on Feed
CO in
CO out 700 °F+ Wax Conversion
80.00
70.00
60.00
50.00
40.00
30.00
20.00
10.00
0.00
0.0
200.0
400.0
600.0
800.0
1000.0
1200.0
Hours on Feed
CO2 in CO2 in
C5-320 °F Yield, wt.% on Feed
10.00
9.00
8.00
7.00
6.00
5.00
4.00
3.00
2.00
1.00
0.00
0.0
200.0
400.0
600.0
800.0
1000.0
1200.0
Hours on Feed 500-700 °F Yield, wt.% on Feed
35.00
30.00
25.00
20.00
15.00
10.00
5.00
0.00
0.0
200.0
400.0
600.0
800.0
1000.0
1200.0
Hours on Feed
CO2 in

CARBON DIOXIDE ADDITION IN HYDROCRACKING/HYDROISOMERIZATION PROCESSES TO CONTROL METHANE PRODUCTION

FIELD OF THE INVENTION

This invention relates to hydroisomerization processes including hydrocracking wherein the reaction is conducted in the presence of carbon dioxide, and terminal cracking, i.e., methane formation, is substantially minimized without substantial effect on $C_2$–$C_4$ yields.

BACKGROUND OF THE INVENTION

Hydroisomerization processes and catalysts therefor are well known, catalysts including noble metals, Pt, Pd, Rh supported on flourided alumina, and Group VIII non-noble metals with or without one or more Group VI metals supported on silica, alumina or silica-alumina. These catalysts are usually bifunctional; they contain a metal hydrogenation catalyst and an acidic cracking function.

Carbon oxides, carbon dioxide and particularly carbon monoxide have have been disclosed in U.S. Pat. No. 3,711,399 as inhibitors of hydrocracking in isomerization processes using highly acidic fluorine containing catalyst, the carbon oxide being added in relatively small amounts. Hydrocracking is virtually completely suppressed and $C_4$-yields are virtually negligible.

Nevertheless, LPG and light liquids yields in these processes are desirable to insure appropriate pour points for diesel and jet fuels. Methane, by itself, is the particularly undesirable product since, for example, isomerized products can be made from Fischer-Tropsch waxes which, in turn, ultimately come from methane via synthesis gas production. Consequently, a desire exists for isomerization processes that suppress or substantially eliminate methane formation without substantial affect on LPG and light liquid yields.

SUMMARY OF THE INVENTION

In accordance with this invention terminal cracking of $C_5$+ hydrocarbons is substantially suppressed, e.g., to less than about 1.0 weight percent based on feed, by conducting a hydroisomerization process incorporating carbon dioxide in the reaction mixture in the presence of a catalyst comprising one or more Group VIII non-noble metals or one or more Group VI metals, or both, the metals being supported on an acidic support comprising alumina or silica alumina.

As a consequence of this invention, LPG and light liquid yields are substantially unaffected while methane yield—resulting from terminal cracking is substantially suppressed. The known literature reports suppression of cracking not only of terminal bonds but also of disubstituted bonds which have a higher activation rate for cracking than terminal bonds. Thus, this invention provides a very selective mechanism for suppressing hydrocracking than the gross operations of the known literature. Further, the literature uses exceedingly low amounts of carbon oxides with highly acidic catalysts. The process of this invention uses greater amounts of carbon dioxide (carbon monoxide not being useful) with a much less acidic catalyst—a decidedly counter-intuitive approach. As a consequence of this invention LPG yields, e.g., $C_2$–$C_4$, and light liquid yields, e.g., $C_5$-320° F. (160° C.), 320°–500° F. (160°– 260° C.) are unaffected while $C_1$ yields are suppressed to less than about 1 wt %, preferably less than about 0.5 wt %.

DESCRIPTION OF THE DRAWINGS

FIG. 1 shows plots of various product yields when carbon monoxide is added to the feed. Time is always on the abscissa.

FIG. 2 shows plots of various product yields when carbon dioxide is added to the feed. Time is always on the abscissa.

Figure 1A:
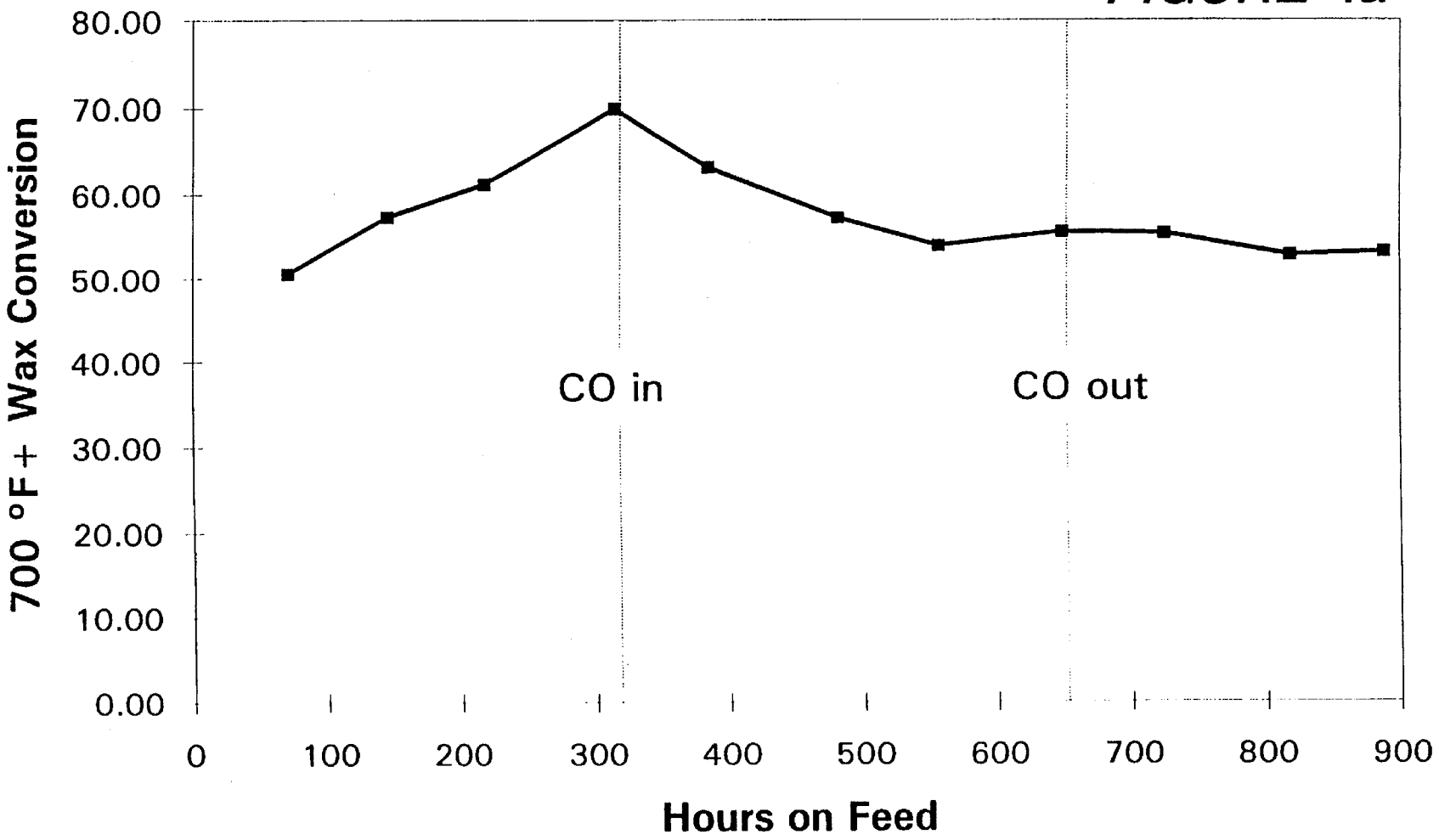
FIGS. 1*a*–1*f* are plots of 700° F.+ (371° C.+) wax conversion, methane yield, $C_2$–$C_4$ yield, $C_5$-320° F. (160° C.) yield, 320°–500° F. (160° –260° C.) yield, and 500°–700° F. (260°–371° C.) yield, all v. time. The first vertical dotted line shows CO in at 320 hours and the second dotted line shows CO out at about 650 hours.

The amount of carbon dioxide used in conjunction with feed is at least about 0.2 mole % based in feed, preferably at least about 0.3 mole %, preferably about 0.3 mole % to about 1.0 mole %. Of interest is the fact that while carbon oxides are often lumped together as catalyst poisons, only carbon dioxide suppressed terminal cracking with the non-noble metal, functional catalyst of this invention; carbon monoxide had virtually no effect on the process.

Total conversion of feed during the process is 20–90%, preferably 30–70%, and more preferably 40–60%.

The active hydroisomerization metals are non-noble metals selected from Group VIII of the Periodic chart of the Elements. Preferred metals are nickel and cobalt or mixtures thereof and mixtures thereof with molybdenum, a Group VI metal. The Group VIII metals may be present on the catalyst in amounts sufficient to be catalytically active for hydroisomerization. Specifically, metal concentrations ranging from about 0.05 to about 20 wt %, preferably about 0.1 to 10 wt %, still more preferably 2.0 to 5.0 wt % may be used. For example, in a preferred catalyst the cobalt loading may be 1–4 wt %, and the nickel loading may be 0.1–1.5 wt %. A Group VI metal such as molybdenum also can be employed in amounts more or less than or equal to the non-noble Group VIII metal, e.g., 1.0 to 20 wt %, preferably 8–15 wt %, in all cases by total weight of catalyst.

The metals are impregnated onto or added to the support as suitable metal salts or acids, e.g., nickel or cobalt nitrate, etc. The catalyst is then dried and calcined in well known fashions.

The base silica and alumina materials used in this invention may be, for example, soluble silicon containing compounds such as alkali metal silicates (preferably where $Na_2O:SiO_2$=1:2 to 1:4), tetraalkoxysilane, orthosilicic acid ester, etc.; sulfates, nitrates, or chlorides of aluminum alkali metal aluminates, or inorganic or organic salts of alkoxides or the like. When precipitating the hydrates of silica or alumina from a solution of such starting materials, a suitable acid or base is added and the pH is set within the range of about 6.0 to 11.0. Precipitation and aging are carried out, with heating, by adding an acid or base under reflux to prevent evaporation of the treating liquid and change of pH. The remainder of the support producing process is the same as those commonly employed, including filtering, drying and calcination of the support material. The support may also contain small amounts, e.g., 1–30 wt % of materials such as magnesia, titania, zirconia, hafnia, or the like.

A preferred support is an amorphous silica-alumina carrier, containing less than about 35 wt % silica, preferably about 2–35 wt % silica, more preferably 5 to 30 wt % silica, and having the following pore-structural characteristics:

| Pore Radius (A) | Pore Volume |
|---|---|
| 0–300 | >0.03 ml/g |
| 100–75,000 | <0.35 ml/g |
| 0–30 | <25% of the volume of the pores with 0–300 A radius |
| 100–300 | <40% of the volume of the pores with 0–300 A radius |

Such materials and their preparation are described more fully in U.S. Pat. No. 3,843,509 incorporated herein by reference. The materials have a surface area ranging from about 180–400 $m^2g$, preferably 230–375 $m^2/g$, a pore volume of 0.3 to 1.0 ml/g, preferably 0.5 to 0.95 ml/g, bulk density of about 0.5–1.0 g/ml, and a side crushing strength of about 0.8 to 3.5 kg/mm.

The feed materials that are isomerized with the catalyst of this invention are waxy feeds, i.e., $C_5$+, preferably boiling above about 350° F. (177° C.) preferably above about 550° F. (288° C.) and may be obtained either from a Fischer-Tropsch process which produces substantially normal paraffins or from slack waxes. Slack waxes are the by-products of dewaxing operations where a diluent such as propane or a ketone (e.g., methylethyl ketone, methyl isobutyl ketone) or other diluent is employed to promote wax crystal growth, the wax being removed from the lubricating oil base stock by filtration or other suitable means. The slack waxes are generally paraffinic in nature, boil above about 600° F. (316° C.), preferably in the range of 600° F. (316° C.) to about 1050° F. (566° C.), and may contain from 1 to 35 wt % oil. Waxes with low oil contents, e.g., 5–20 wt % are preferred; however, waxy distillates or raffinates containing 5–45% wax may also be used as feeds. Slack waxes are usually freed of polynuclear aromatics and heteroatom compounds by techniques known in the art, e.g., mild hydrotreating as described in U.S. Pat. No. 4,900,707, which also reduces sulfur and nitrogen levels preferably to less than 5 ppm and less than 2 ppm, respectively. Fischer-Tropsch waxes are preferred feed materials, having negligible amounts of aromatics, sulfur and nitrogen compounds.

Isomerization conditions include temperatures of 300°–400° C., 500–3000 psig hydrogen, 1000–10,000 SCF/bbl hydrogen treat and space velocity of 0.1–10.0 LHSV. Preferred conditions include 320°–385° C., 750–1500 psig hydrogen, 0.5–2 v/v/hr.

The catalyst is generally employed in a particulate form, e.g., cylindrical extrudates, trilobes, quadrilobes, and ranging in size from about 1–5 mm. The hydroisomerization can be carried out in a fixed bed reactor and the products may be recovered by distillation.

The following examples will illustrate this invention but are not meant to be limiting in any way.

All of the hydroisomerization studies were carried out in a small upflow pilot plant. The catalyst was evaluated at 750 psig, 0.50 LHSV, 690°–700° F. (366°–377° C.), and with a nominal $H_2$ treat rate of 2500 SCF/B. A 10 cc charge of catalyst crushed and sized to 14/35 mesh was employed in each case. The catalyst comprised 15.2 wt % $MoO_3$ and 3.2 wt % CoO on a silica-alumina Co gel with 20–30 wt % bulk silica. Balances were typically collected at 24–72 hour intervals. The reaction temperature was set to meet a target of 50% 700° F.+ wax conversion and was not adjusted during the run. The Fischer-Tropsch wax employed in these studies had a nominal composition of 0.70% IBP-500° F. (260° C.), 20.48% 500°–700° F. (260°–371° C.), 78.82% 700° F.+ (371° C.). Typical run lengths were 800–1000 hours. Boiling range distributions for gas, naphtha, distillate range products, and lubes were obtained by a combination of simulated gas chromatography distillation and gas chromatography-mass spectroscopy.

The effect of carbon monoxide was evaluated and the catalyst was activated using the following procedure:

1. Pressure test at 100° F. (38° C.) at ca. 750 psi hydrogen pressure.
2. Reactor temperature increased to 700° F. (371° C.) while maintaining hydrogen pressure at 750 psi and a flow rate of 2500 SCF/bbl.
3. Reactor temperature held at 700° F. (371° C.) for approximately 18 hours.
4. Hydrogen feed and pressure were adjusted to standard operating conditions and feed was cut in feed to start operation.

After feed was cut in, balances were collected on a regular basis for 16 days to ensure that the catalyst had lined out, i.e., reached steady state conditions. At this point, the gas was switched from pure hydrogen to a mixture containing 0.405 mole % carbon monoxide in a balance of hydrogen. After 13 days on the $CO/H_2$ mixture, the gas was switched back to pure hydrogen for the remainder of the run.

In this case there was an increase in $C_1$ (methane), likely due to the hydrogenation of CO under reaction conditions.

The effect of carbon dioxide was studied also. In this case a somewhat different but similar catalyst activation procedure was used and is outlined below. This activation procedure leads to high methane yields.

1. Reactor temperature increased to 250° F. (121° C.) at atmospheric pressure under nitrogen.
2. Pressure test with nitrogen, followed by pressure test with hydrogen, while maintaining reactor temperature at 250° F. (121° C.).
3. Reactor pressure increased to 1250 psia with hydrogen flow rate at 3400 SCF/B. Reactor temperature increased at a rate of 30° F. (16° C.) per hour to 700° F. (371° C.). Once reactor temperature reaches 700° F. (371° C.), hold for approximately 4–5 hours.
4. Pressure test hot with hydrogen; reduce hydrogen feed and pressure to standard operating conditions; cut in feed to start operation.

As in the previous run, once feed was cut-in balances were collected on a regular basis for 13.5 days to ensure that the catalyst had lined out. At this point the gas was switched from pure hydrogen to a mixture of 0.604 mole % carbon dioxide, the balance being hydrogen for the remainder of the run.

Figure 1B:
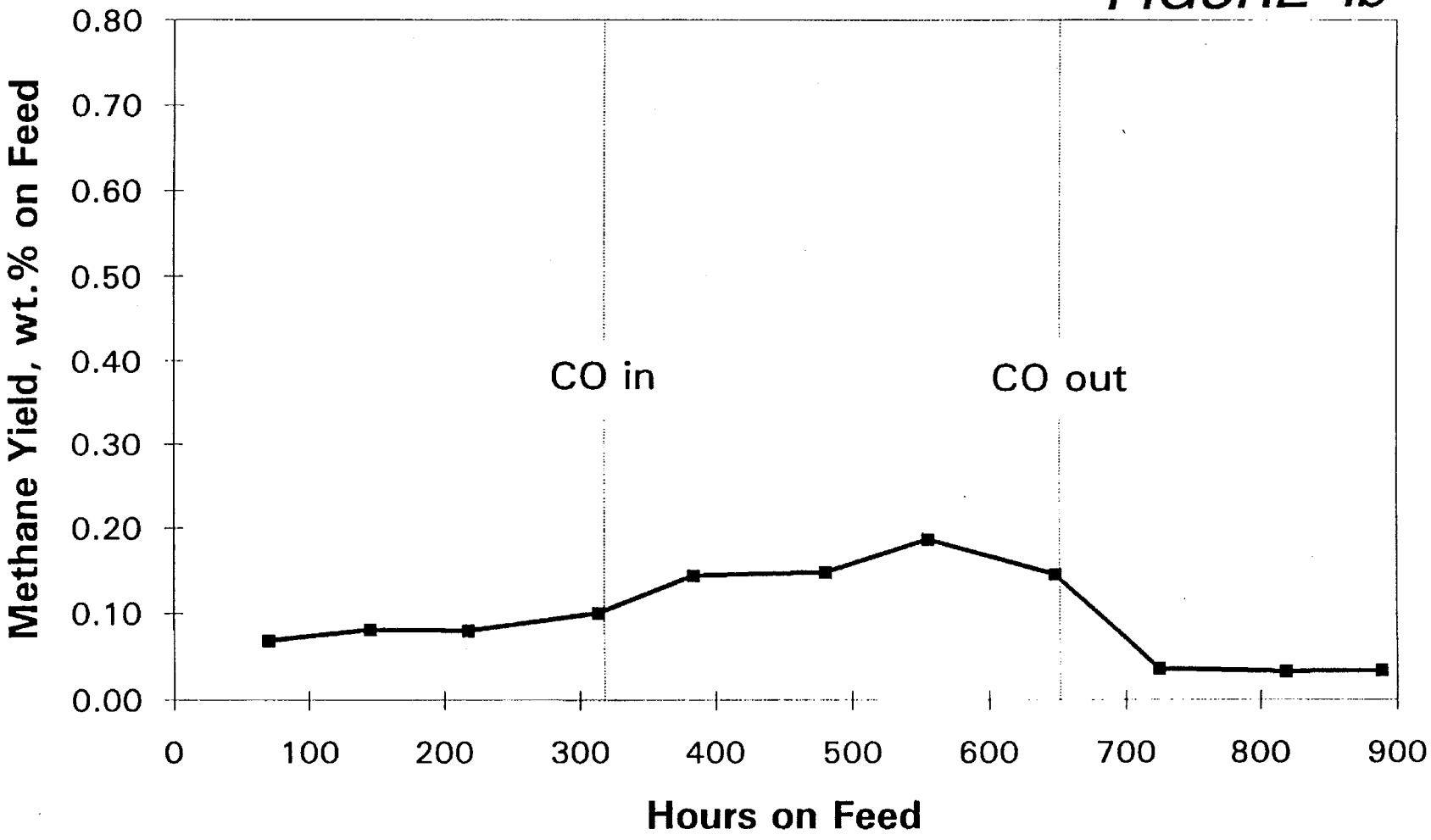
Figure 1C:
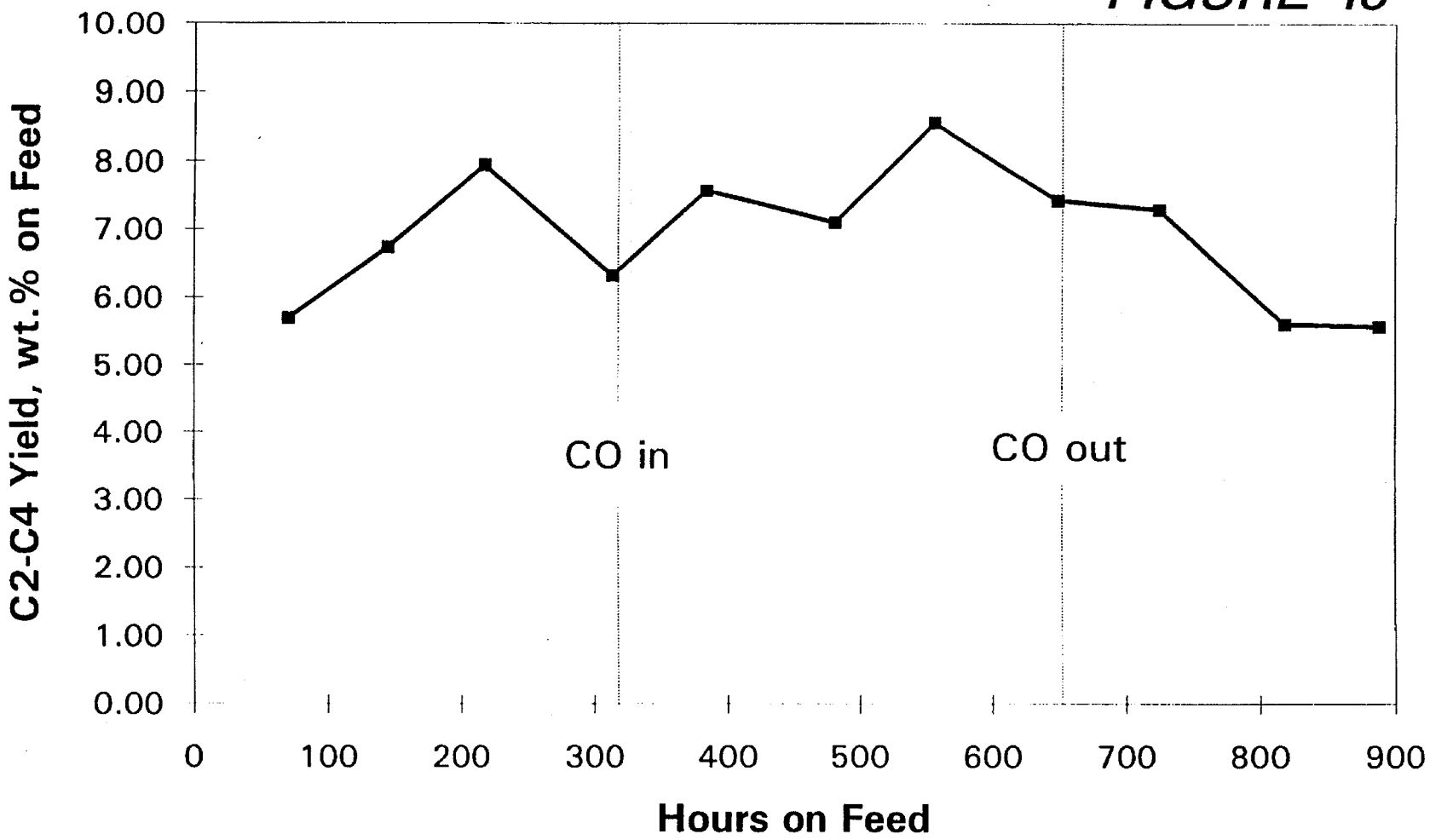
Figure 1D:
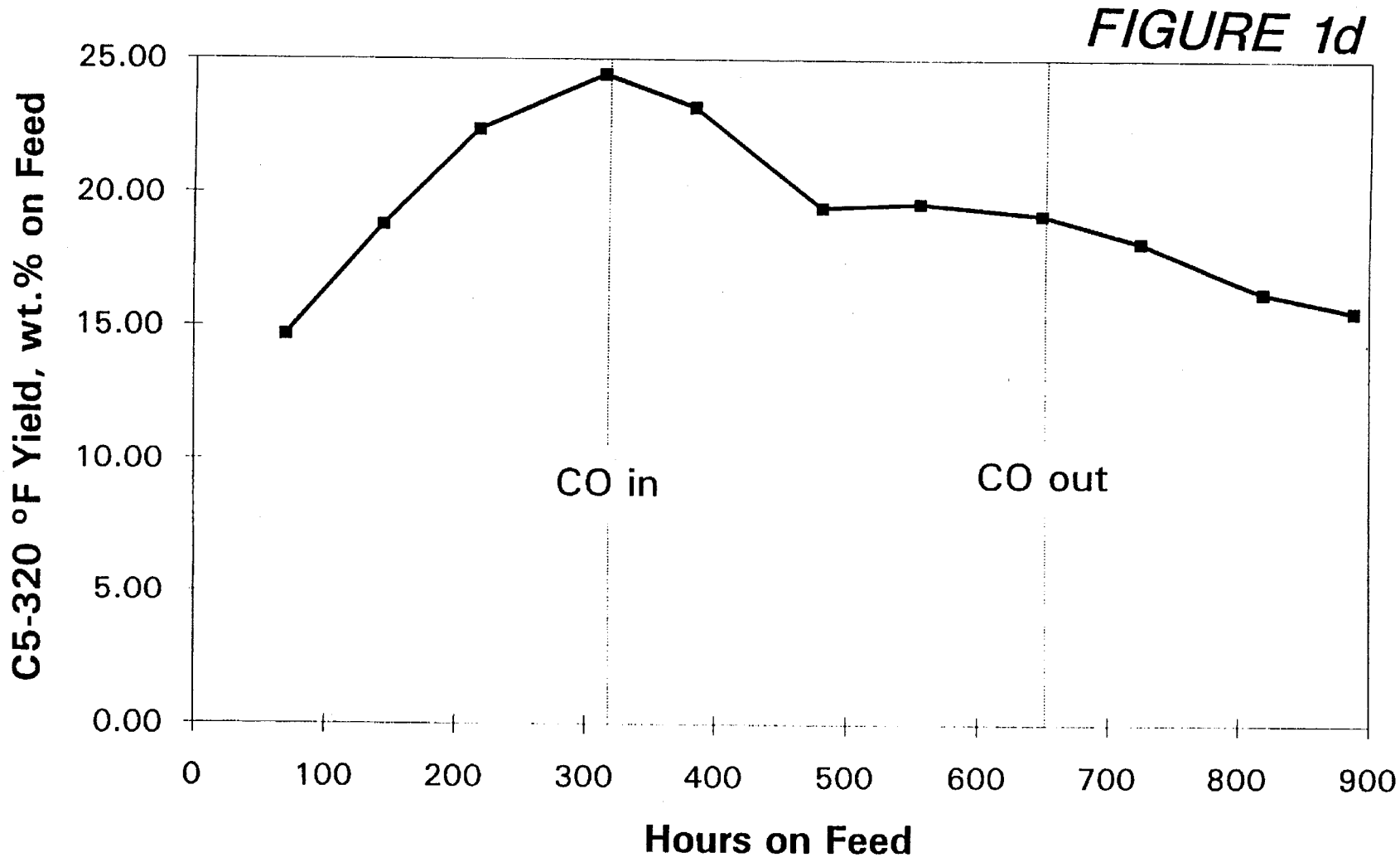
Figure 1E:
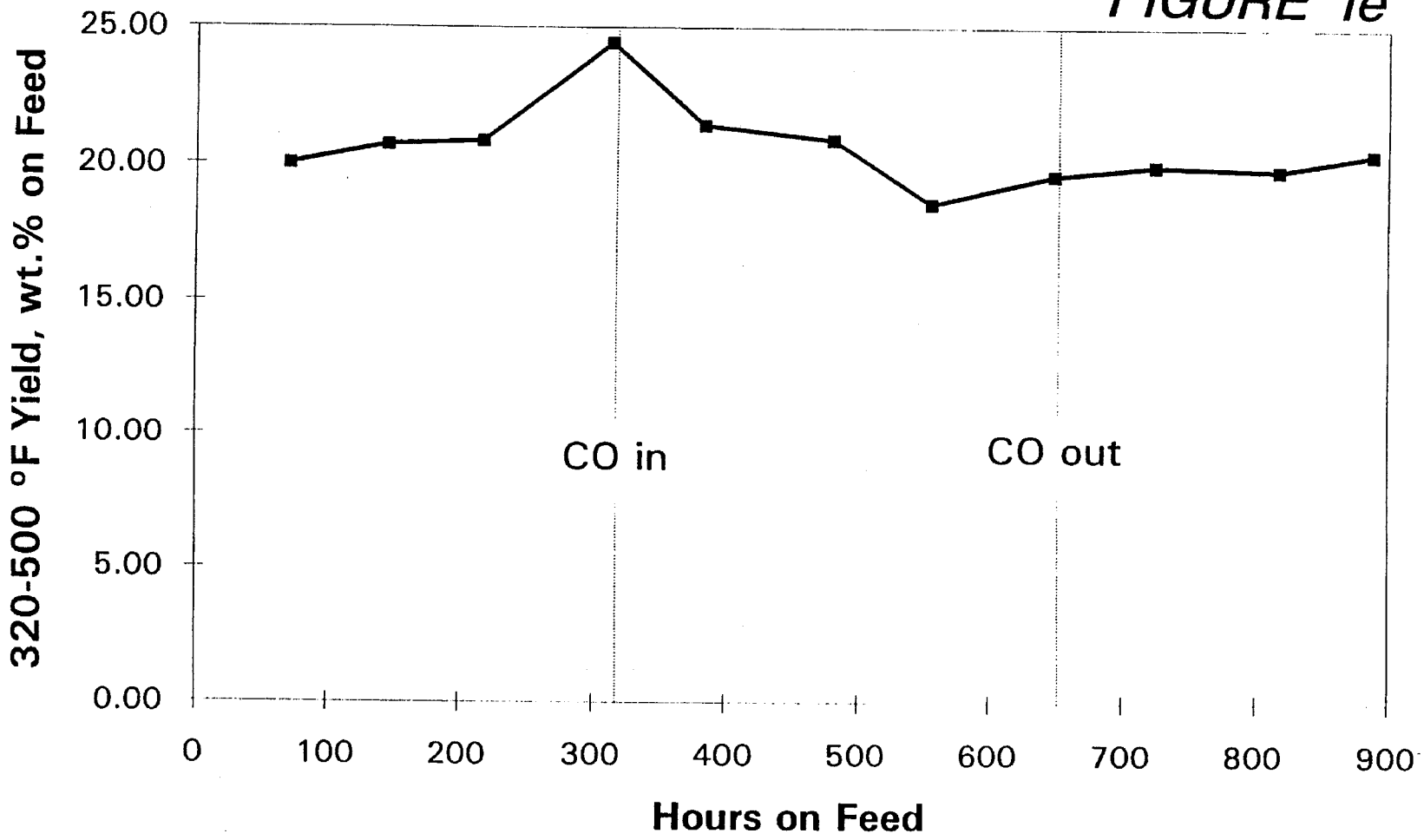
Figure 1F:
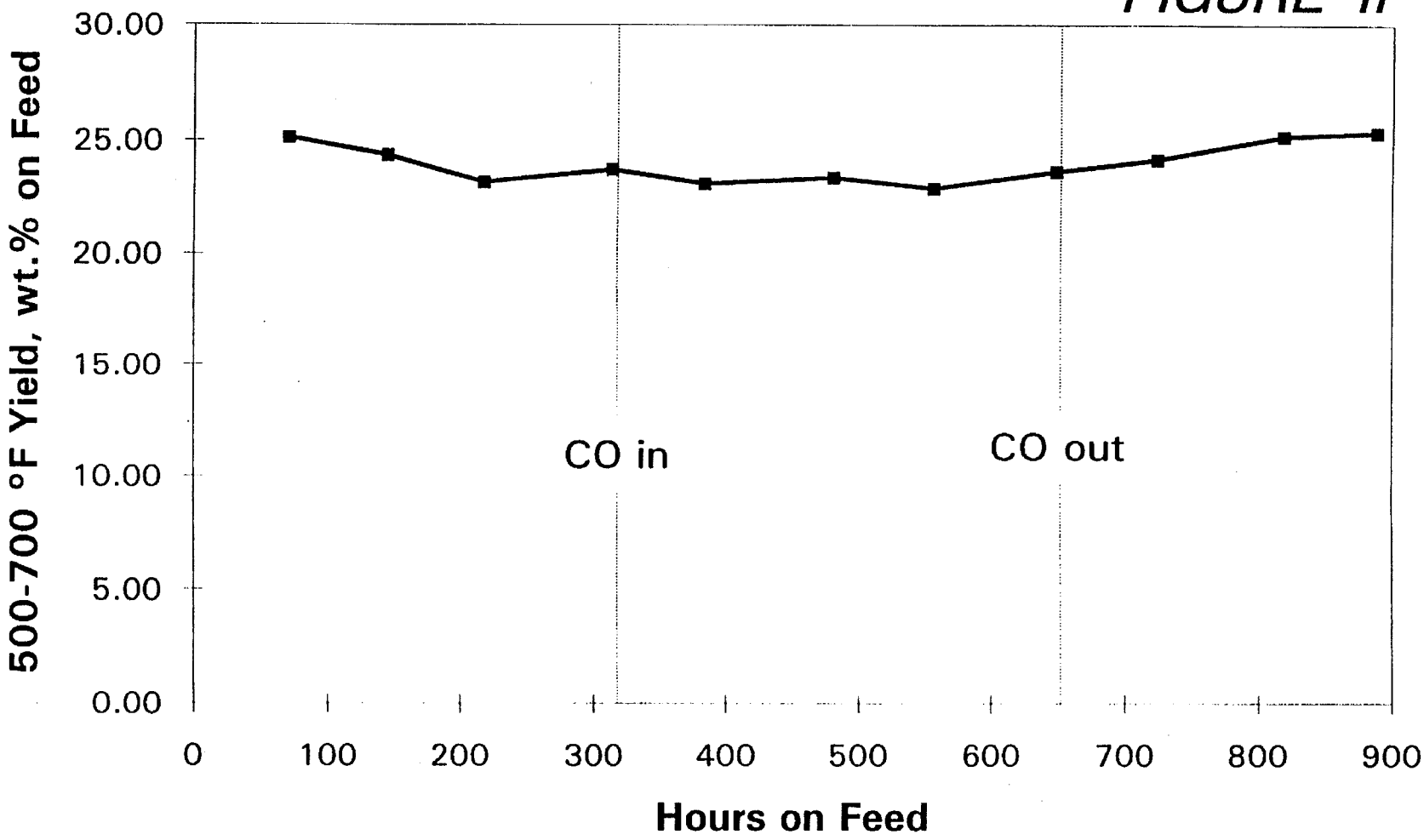

The effect of carbon monoxide on the catalyst performance is displayed graphically in FIG. 1. In general, the CO seemed to have very little impact on the catalyst performance. The most significant effect was a decrease in the 700° F.+ (371° C.+) wax conversion which was observed almost immediately after the CO was introduced. This decrease continued until the conversion leveled off at about 55 percent and stayed at this level even when pure hydrogen was reintroduced to the system.

A small change in the methane yield was also detected. The methane yield actually increased when the CO was introduced. This occurred even though the conversion level was decreasing. Generally, methane yield tracks reasonably well with conversion (i.e., an increase in conversion usually leads to an increase in methane). However, in this case, the slight increase in methane yield may be due to CO hydrogenation, particularly since the methane level drops significantly when pure hydrogen is reintroduced and corresponds almost exactly with the amount of methane which would be produced if the CO was quantitatively converted to methane.

Examination of the remaining products (e.g., $C_2$–$C_4$, $C_5$-320° F. (160° C.), 320°–500° F. (160°–260° C.), 500°–700° F. (260°–371° C.)) reveal little or no effect from the CO other than differences attributed to the change in conversion.

Figure 2A:
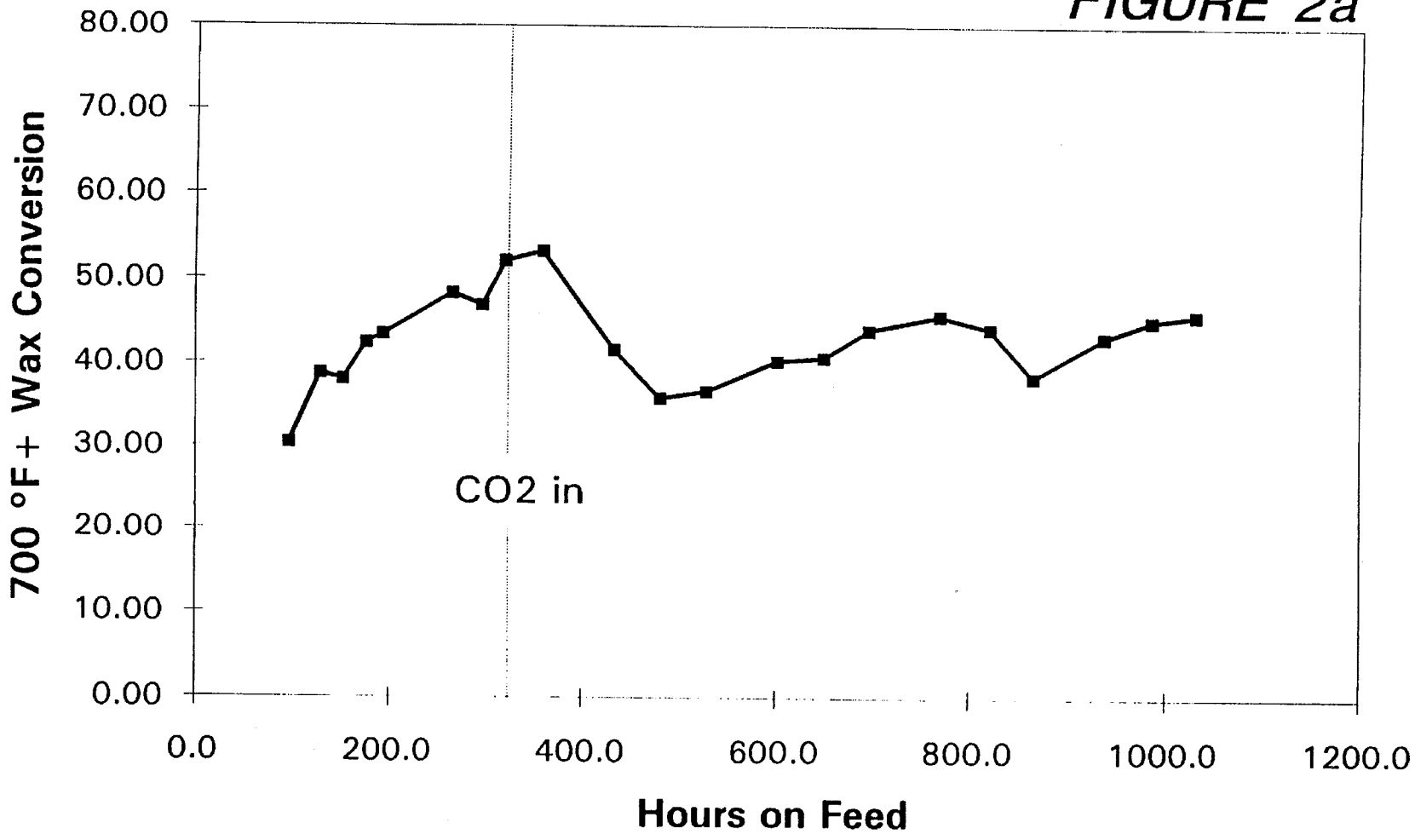
FIGS. 2*a*–2*f* show yields for the same products as in FIGS. 1*a*–1*f*. The dotted line shows $CO_2$ in at about 320 hours.
Figure 2B:
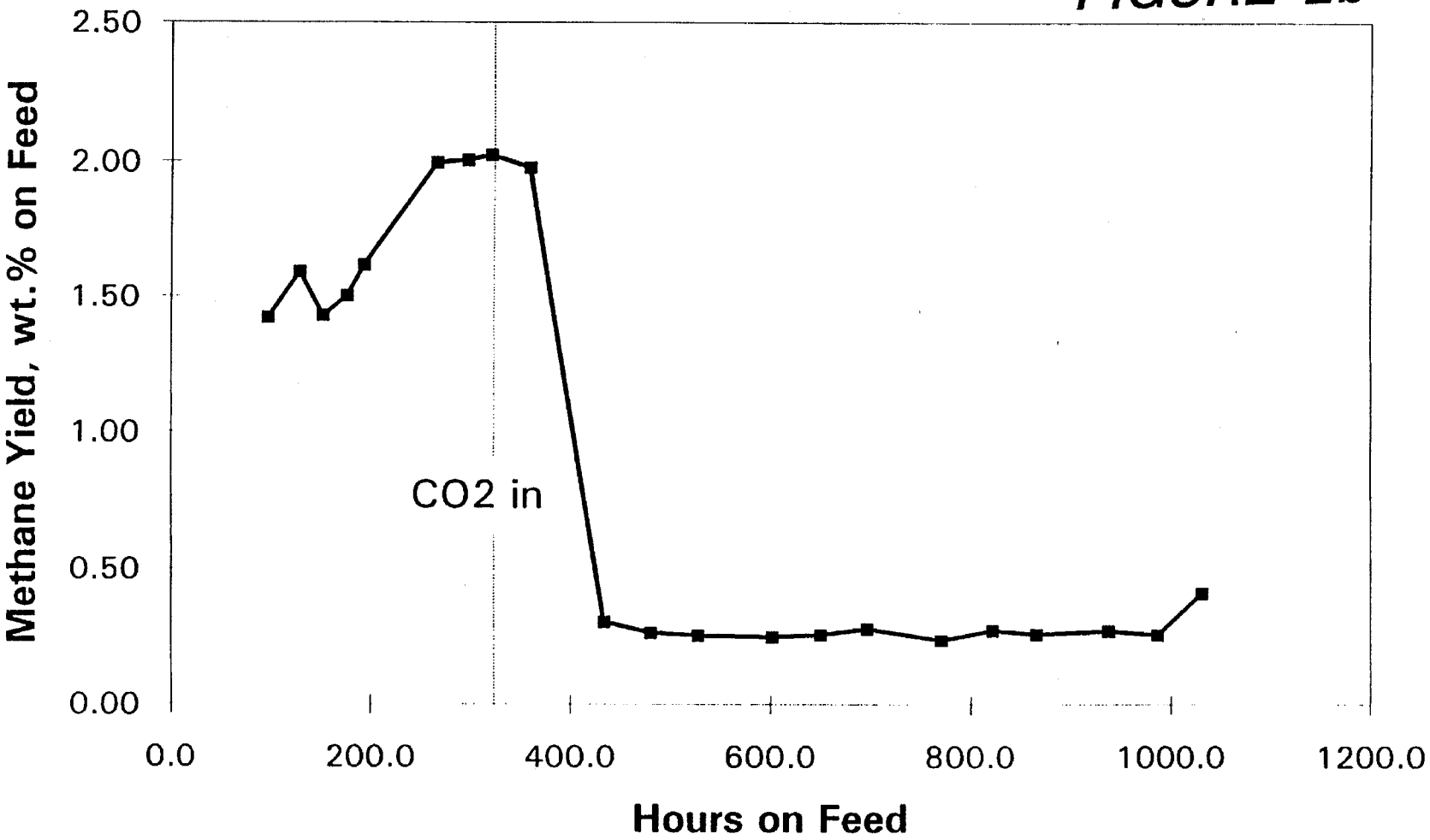
Figure 2C:
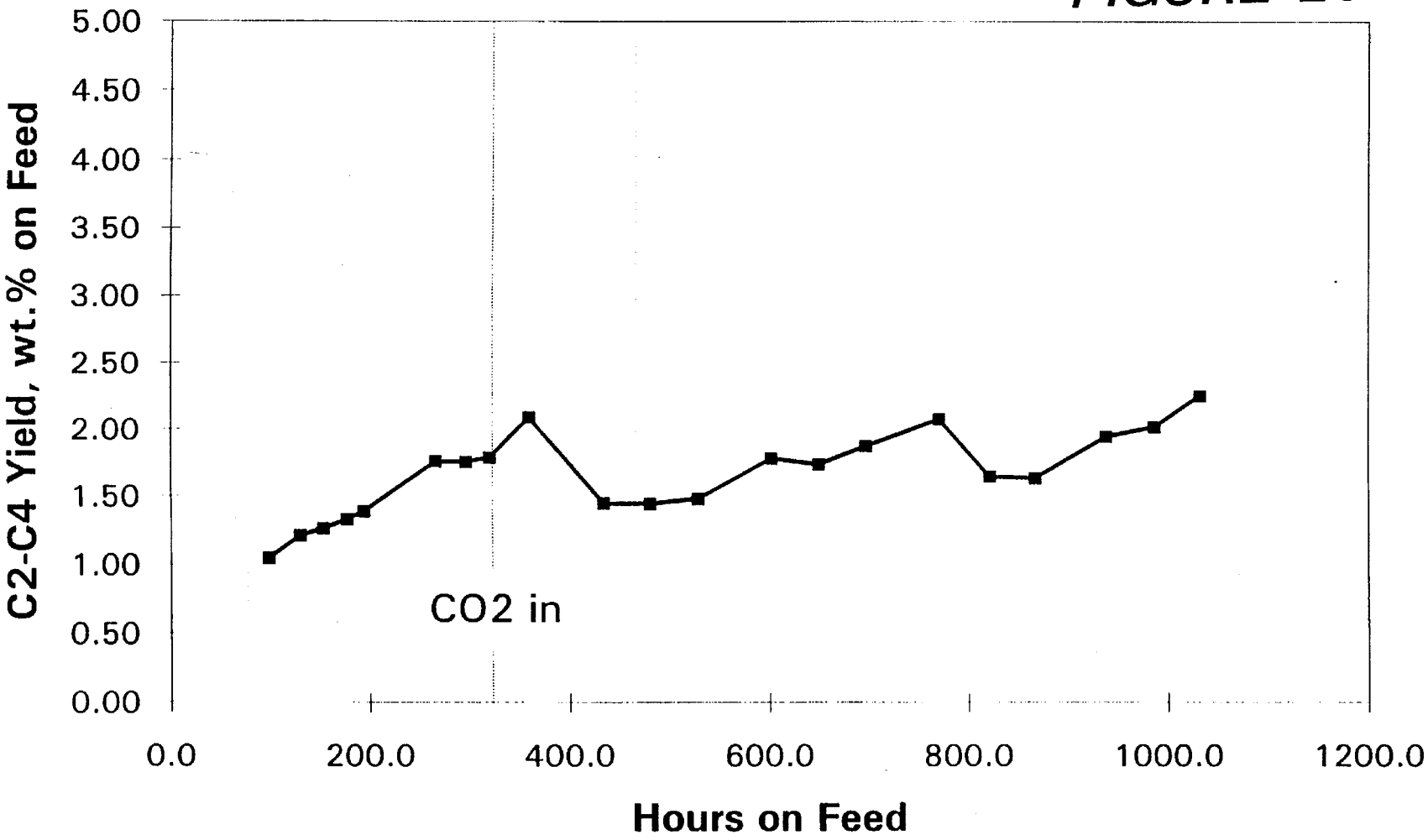
Figure 2D:
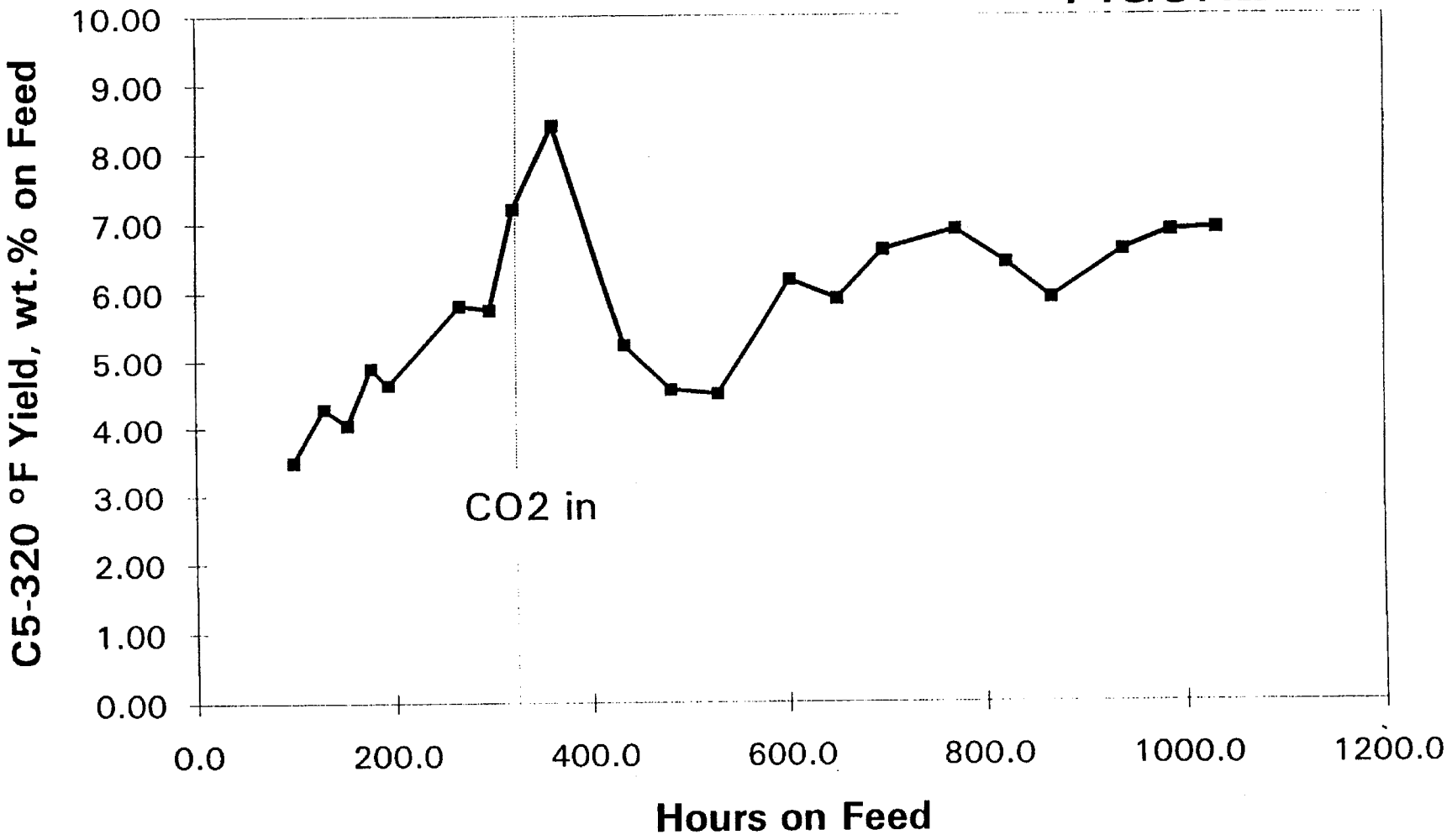
Figure 2E:
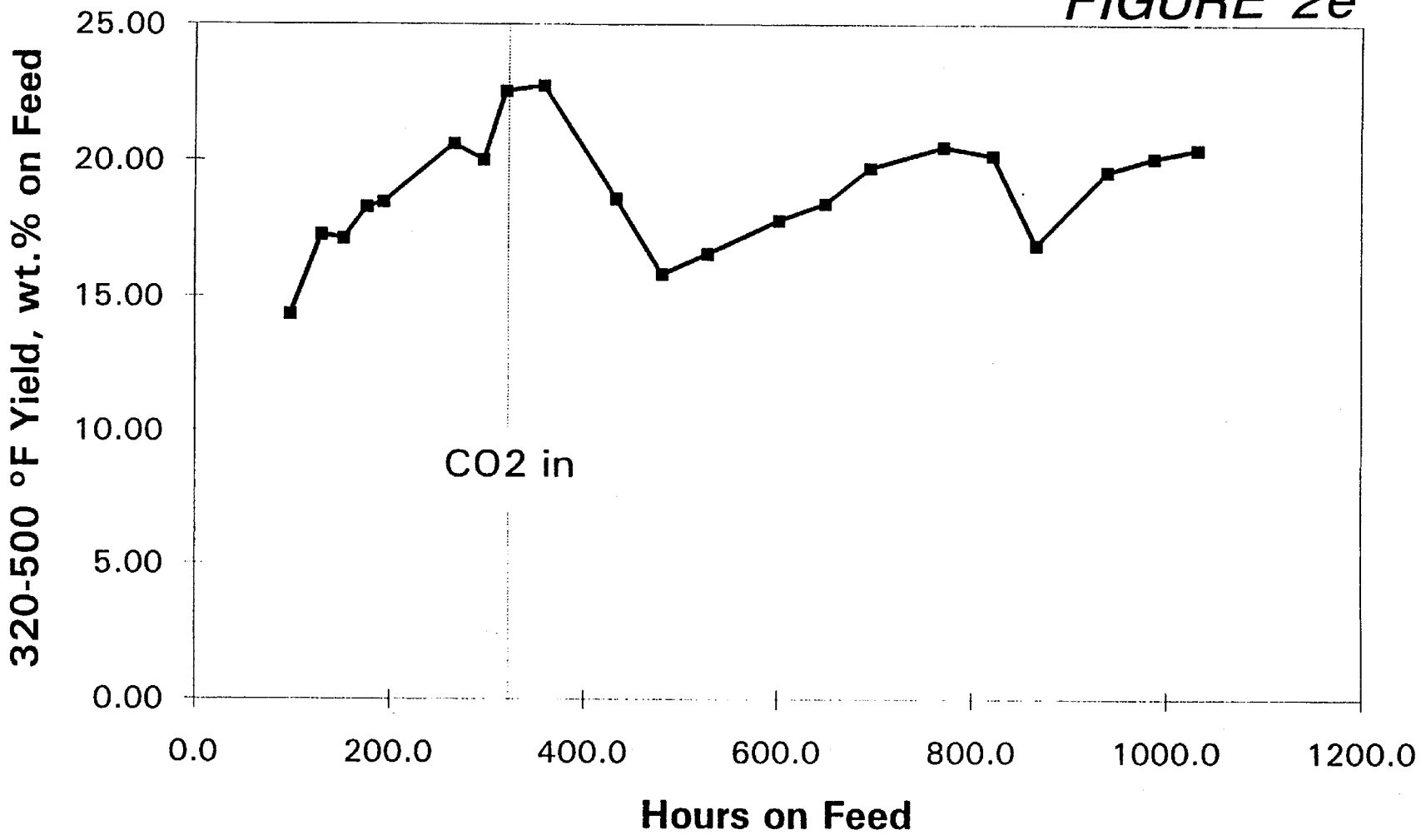
Figure 2F:
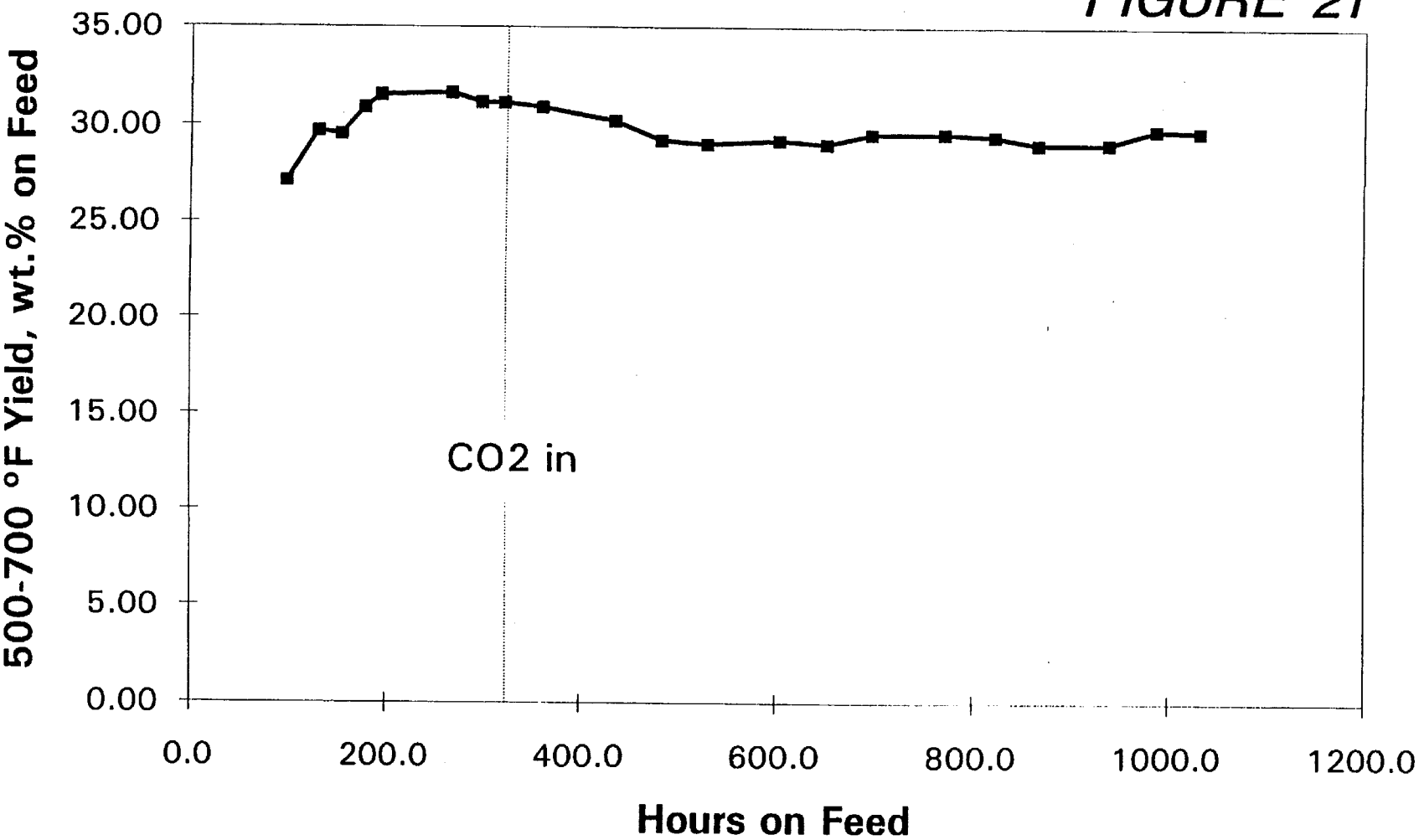

The effect of carbon dioxide on the catalyst performance is displayed graphically in FIG. 2. Although the product selectivities for this run are significantly different than those obtained in the CO experiment (primarily due to the different activation procedures), it is the relative effect of the $CO_2$ that is of primary importance.

Shortly after the introduction of the $CO_2/H_2$ mixture, the 700° F.+ (371° C.+) wax conversion decreased by about 17%. The conversion slowly started to increase thereafter but did not reached the original level.

The methane yield shows the most dramatic change as a result of the $CO_2$. The activation procedure used in this run caused an extremely high methane yield of about 2 wt %. Introduction of $CO_2$ caused this level to drop to less than 0.30 wt % where it remained for the duration of the run. A small reduction in the methane yield would be expected due to the decrease in the conversion; however, the effect is too great to account for the total reduction.

Examination of the remaining products (e.g., $C_2$–$C_4$, $C_5$-320° F. (160° C.), 320°–500° F. (160°–260° C.), 500°–700° F. (260°–371° C.) reveal little or no effect from the $CO_2$ other than differences attributed to the changes in conversion.

The following table illustrates the actual product yields for the $CO_2$ experiment.

| | | | | | |
|---|---|---|---|---|---|
| Total Time On Run (Hours) | 297.0 | 320.5 | 434.0 | 650.0 | 770.5 |
| Delta Time | — | t = 0 | t = 113.5 | t = 329.5 | t = 450 |
| 700° F.+ Conversion | 46.88 | 52.12 | 41.64 | 40.67 | 45.71 |
| $CH_4$ | 2.005 | 2.022 | 0.265 | 0.256 | 0.237 |
| $C_2H_6$ | 0.196 | 0.190 | 0.033 | 0.037 | 0.043 |
| $C_3H_8$ | 0.416 | 0.414 | 0.358 | 0.408 | 0.472 |
| $C_4H_{10}$ | 1.140 | 1.182 | 1.054 | 1.289 | 1.555 |

t = 0 is the point at which carbon dioxide was added

These data were taken after line-out had been achieved.

From the table it is clear that $C_1$ (methane) was substantially suppressed; $C_2$ was suppressed somewhat, $C_3$ and $C_4$ were virtually unaffected and as a result $C_2$–$C_4$ was substantially unaffected. Additionally, total conversion was suppressed at the outset of $CO_2$ addition, and recovered somewhat as the reaction proceeded. Thus, $C_2$–$C_4$ cracked products can range from about 1 wt % to about 3 wt %.

What is claimed is:

1. A hydroisomerization process in which $C_1$ yields are suppressed without substantial effect on other light gas yields which comprises reacting at hydroisomerization reaction conditions a $C_5$+ paraffinic feedstock in the presence of hydrogen and at least about 0.2 mole % carbon dioxide based on feed and a catalyst comprising a Group VIII non-noble metal and a Group VI metal supported on alumina or silica-alumina.

2. The process of claim 1 wherein the reaction conditions include temperatures of about 300°–400° C.

3. The process of claim 1 wherein a Group VIII metal is cobalt and a Group VI metal is molybdenum.

4. The process of claim 2 wherein the support is a silica-alumina support and the silica is less than about 35 wt % of the support.

5. The process of claim 2 wherein the methane content of the isomerized product is less than about 1 wt % on feed.

6. The process of claim 4 wherein the support contains about 2–30 wt % silica.

7. The process of claim 6 wherein the surface area of the support is about 180–400 $m^2$/gm.

8. The process of claim 6 wherein the carbon dioxide is present in amounts of about 0.3 to 1.0 mole %.

9. The process of claim 8 wherein the total conversion of the feed is about 30–70%.

10. The process of claim 1 wherein hydrocracking is selectively suppressed.

11. The process of claim 1 wherein the $C_2$–$C_4$ cracked products are about 1–3 wt %.

* * * * *